US007584878B2

(12) United States Patent
Kandasamy

(10) Patent No.: US 7,584,878 B2
(45) Date of Patent: Sep. 8, 2009

(54) PAPER TOOL DRIVE LINKAGE

(75) Inventor: Balaji Kandasamy, Naperville, IL (US)

(73) Assignee: ACCO Brands USA LLC, Lincolnshire, IL (US)

( * ) Notice: Subject to any disclaimer, the term of this patent is extended or adjusted under 35 U.S.C. 154(b) by 193 days.

(21) Appl. No.: 11/530,322

(22) Filed: Sep. 8, 2006

(65) Prior Publication Data

US 2007/0227286 A1 Oct. 4, 2007

Related U.S. Application Data

(60) Provisional application No. 60/715,254, filed on Sep. 8, 2005.

(51) Int. Cl.
*B25C 5/06* (2006.01)

(52) U.S. Cl. ..... 227/120; 227/76; 227/134; 83/618; 83/684

(58) Field of Classification Search ..... 227/120, 227/131, 132, 134, 64, 76; 83/167, 468, 83/618, 633, 684, 687, 686
See application file for complete search history.

(56) References Cited

U.S. PATENT DOCUMENTS

| | | | | |
|---|---|---|---|---|
| 41,861 | A | 3/1864 | Renfrew | |
| 383,200 | A | 5/1888 | Weber et al. | |
| 1,054,132 | A | 2/1913 | Miner | |
| 1,615,020 | A | 1/1927 | Loehr | |
| 1,728,475 | A | 9/1929 | Cavill | |
| 1,962,874 | A | 6/1934 | Fridolin | |
| 1,998,328 | A | 4/1935 | McKinnie | |
| 2,326,540 | A * | 8/1943 | Krantz | 173/31 |
| 2,382,523 | A | 8/1945 | Unger | |
| 2,482,218 | A | 9/1949 | Segal | |
| 2,671,215 | A * | 3/1954 | Abrams | 227/132 |
| 2,962,178 | A | 11/1960 | Exline | |
| 3,181,408 | A | 5/1965 | Richards | |
| 3,590,484 | A | 7/1971 | Walsh | |
| 3,735,655 | A | 5/1973 | Dedona et al. | |
| 3,748,936 | A | 7/1973 | Minasy | |
| 3,756,625 | A | 9/1973 | Abilgaard et al. | |
| 3,793,660 | A | 2/1974 | Sims | |
| 3,821,890 | A | 7/1974 | Dewey | |
| 3,826,168 | A | 7/1974 | Groswith, III et al. | |
| 3,921,487 | A | 11/1975 | Otsuka et al. | |

(Continued)

FOREIGN PATENT DOCUMENTS

| | | |
|---|---|---|
| CH | 252144 | 9/1948 |

(Continued)

OTHER PUBLICATIONS

Unpublished U.S. Appl. No. 11/424,618, filed Jun. 16, 2006.

(Continued)

*Primary Examiner*—Scott A. Smith
(74) *Attorney, Agent, or Firm*—Michael Best & Friedrich LLP

(57) ABSTRACT

A paper tool includes a power transmission linkage. The linkage includes a base, a drive link, an input member, and at least three pivots connecting members of the linkage. At least one of the pivots provides for both rotational and translational movement between two members connected by the at least one pivot.

28 Claims, 10 Drawing Sheets

U.S. PATENT DOCUMENTS

| | | | | | |
|---|---|---|---|---|---|
| 4,019,415 | A | | 4/1977 | Wich | |
| 4,036,088 | A | | 7/1977 | Ruskin | |
| 4,077,288 | A | | 3/1978 | Holland | |
| 4,126,260 | A | * | 11/1978 | Mickelsson | 227/132 |
| 4,173,162 | A | | 11/1979 | Shaughnessy | |
| 4,184,396 | A | | 1/1980 | Hafner | |
| 4,294,152 | A | | 10/1981 | Land | |
| 4,301,723 | A | | 11/1981 | Borzym | |
| 4,499,805 | A | | 2/1985 | Mori | |
| 4,611,520 | A | | 9/1986 | Terracciano | |
| 4,645,399 | A | | 2/1987 | Scharer | |
| 4,656,907 | A | | 4/1987 | Hymmen | |
| 4,664,004 | A | | 5/1987 | Randall | |
| 4,706,533 | A | | 11/1987 | Giulie | |
| 4,713,995 | A | | 12/1987 | Davi | |
| 4,833,958 | A | | 5/1989 | Abildgaard et al. | |
| 4,987,811 | A | * | 1/1991 | Ikarashi et al. | 83/372 |
| 4,993,291 | A | | 2/1991 | Sopko | |
| 5,007,782 | A | | 4/1991 | Groswith, III et al. | |
| 5,040,441 | A | | 8/1991 | Tamura | |
| 5,044,242 | A | | 9/1991 | Chiang | |
| 5,143,502 | A | | 9/1992 | Kaufmann et al. | |
| 5,163,350 | A | | 11/1992 | Groswith, III et al. | |
| 5,174,794 | A | | 12/1992 | Brownlee et al. | |
| 5,247,863 | A | | 9/1993 | Cohen | |
| 5,273,387 | A | | 12/1993 | Groswith, III et al. | |
| 5,335,839 | A | | 8/1994 | Fealey | |
| 5,377,415 | A | | 1/1995 | Gibson | |
| 5,431,519 | A | | 7/1995 | Baumann | |
| 5,492,261 | A | | 2/1996 | Chi | |
| 5,494,364 | A | | 2/1996 | Murakami et al. | |
| 5,497,932 | A | * | 3/1996 | Brewer et al. | 227/132 |
| 5,639,007 | A | | 6/1997 | Nakamura | |
| 5,664,473 | A | | 9/1997 | Huang | |
| 5,664,722 | A | * | 9/1997 | Marks | 227/132 |
| 5,683,218 | A | | 11/1997 | Mori | |
| 5,740,712 | A | | 4/1998 | Watkins et al. | |
| 5,758,813 | A | | 6/1998 | Kikuchi et al. | |
| 5,765,742 | A | * | 6/1998 | Marks | 227/132 |
| 5,778,750 | A | | 7/1998 | Drzewiecki et al. | |
| 5,890,642 | A | | 4/1999 | Sato | |
| 5,979,736 | A | | 11/1999 | Edeholt | |
| 6,145,728 | A | * | 11/2000 | Marks | 227/132 |
| 6,179,193 | B1 | | 1/2001 | Nagai | |
| 6,547,119 | B2 | | 4/2003 | Huang | |
| 6,550,661 | B2 | | 4/2003 | Aoki | |
| 6,688,199 | B2 | | 2/2004 | Godston et al. | |
| 6,776,321 | B2 | | 8/2004 | Jairam et al. | |
| 6,789,719 | B2 | * | 9/2004 | Shor | 227/132 |
| 6,918,525 | B2 | | 7/2005 | Marks | |
| 6,966,479 | B2 | | 11/2005 | Tanaka et al. | |
| 7,124,924 | B2 | * | 10/2006 | Marks | 227/120 |
| 7,299,960 | B1 | * | 11/2007 | Marks | 227/132 |
| 7,395,955 | B2 | * | 7/2008 | Zins et al. | 227/132 |
| 2002/0005427 | A1 | | 1/2002 | Aoki | |
| 2002/0020272 | A1 | | 2/2002 | Godston et al. | |
| 2003/0047581 | A1 | | 3/2003 | Tanaka et al. | |
| 2003/0155400 | A1 | | 8/2003 | Jairam et al. | |
| 2004/0069110 | A1 | | 4/2004 | Godston et al. | |
| 2006/0138192 | A1 | | 6/2006 | Matsukawa | |
| 2007/0044618 | A1 | | 3/2007 | Marks | |
| 2007/0044623 | A1 | | 3/2007 | Marks | |
| 2007/0044624 | A1 | | 3/2007 | Marks | |
| 2007/0169603 | A1 | | 7/2007 | Marks | |
| 2007/0199424 | A1 | | 8/2007 | Marks | |
| 2007/0266836 | A1 | | 11/2007 | Marks | |
| 2007/0267472 | A1 | | 11/2007 | Marks | |

FOREIGN PATENT DOCUMENTS

| | | | |
|---|---|---|---|
| DE | 1042530 | | 11/1958 |
| EP | 0283676 | | 9/1988 |
| EP | 0385034 | | 9/1990 |
| EP | 0761392 | | 3/1997 |
| FR | 994186 | | 11/1951 |
| JP | 4300198 | | 10/1992 |
| WO | 2007/055297 | A1 | 5/2007 |
| WO | 2007/055298 | A1 | 5/2007 |
| WO | 2007/055398 | A1 | 5/2007 |
| WO | 2007/058337 | A1 | 5/2007 |
| WO | 2007087309 | A2 | 8/2007 |

OTHER PUBLICATIONS

International Search Report and Written Opinion for corresponding International Application No. PCT/US07/87157 mailed on Jul. 31, 2008.

International Search Report and Written Opinion for corresponding International Application No. PCT/US2006/035022 mailed on Dec. 6, 2006.

* cited by examiner

PAPER TOOL DRIVE LINKAGE

RELATED APPLICATIONS

This application claims priority to U.S. Provisional Patent Application Ser. No. 60/715,254 filed on Sep. 8, 2005, the entire content of which is incorporated herein by reference.

FIELD OF THE INVENTION

The present invention relates to a paper tool. More particularly, the invention relates to a paper punch, stapler, or paper trimmer having an improved linkage to provide a mechanical advantage to the paper tool.

BACKGROUND OF THE INVENTION

Paper tools, including paper punches, staplers, and paper trimmers, are configured such that force input by a user results in an operation on paper or other substrates. For example, in a typical paper punch, the user actuates a handle, which causes a punch pin to move downwardly to punch a hole in a stack of sheets inserted into the punch. Punches that employ a linkage to actuate the punch typically include links generally aligned above a vertically oriented punch mechanism. The linkage increases the mechanical advantage within the punch such that less force input is required from the user to perform the punching operations. Staplers are also known that include linkages for increasing the mechanical advantage of the stapler during stapling operations. Paper trimmers can also be configured to contain similar linkages for increasing mechanical advantage.

Four-bar linkages are known in the construction of paper punches and staplers. One example of such a four-bar linkage in a paper punch is shown in U.S. Pat. No. 6,688,199 and prior-art FIG. 1. FIG. 1 illustrates a paper punch 100 generally including a base 110, punch pins 112 (only one shown), and a linkage for actuating the punch pins 112. The linkage is configured as a four-bar linkage including a drive member 114, a first end cap 118, and a handle member 122. The drive member 114 is pivotably coupled to the base 110 at pivot 120, and the handle member 122 is pivotably coupled to the drive member 114 at pivot 126. The handle member 122 is also pivotably coupled to a second end cap (not shown—positioned at one end of the punch 100) at pivot 134, while the second end cap is pivotably coupled to the base 110 at pivot 138.

FIG. 1 also schematically illustrates the "links" representative of the base 110, drive member 114, handle member 122, and the second end cap in a four-bar linkage. The base 110 is schematically illustrated by link 142, which is representative of the "ground," which is stationary in a four-bar linkage. The second end cap is schematically illustrated by link 146, which is representative of the "crank" in a four-bar linkage. The drive member 114 is schematically illustrated by link 150, which is representative of the "rocker" or "output link," which provides the output force or motion to the pivot pins 112. The handle member 122 is schematically illustrated by link 154, which is representative of the "coupler" or "coupler link," which connects the link 146 (the "crank") and the link 150 (the "rocker") in the four-bar linkage.

Such a four-bar linkage, when utilized in a paper punch, includes three movable links (i.e., the links 146, 150, 154) and a sliding point of contact, whether rotationally sliding or through an elongated cam slot. In the paper punch 100 illustrated in FIG. 1, a push bar in the form of a cylindrical rod 158 is received in respective grooves 162 in the drive members 114. During actuation of the punch pins 112, sliding contact occurs between the rod 158 coupled with the drive members 114 and the punch pins 112 to transfer the pivoting motion of the drive members 114 to linear motion of the punch pins 112.

In typical manually-operated staplers, the upper cover often directly applies a force to the staple driver to drive a staple into a stack of sheets or other materials. Other staplers, such as the staplers shown in U.S. Pat. Nos. 6,966,479, 6,550,661, 6,776,321, and 6,179,193, have used the leverage provided by two pivots and a sliding contact, rather than a four-bar linkage. Such staplers have only a main body pivot and a cover or handle pivot. The pivot between the magazine and the cover can facilitate opening the stapler for staple loading. Cam slots have been used in staplers, such as the stapler shown in U.S. Pat. No. 6,966,479, but only to provide clearance for opening the upper cover when loading staples into the stapler magazine. Such cam slots have not been used in the mechanism or linkage that transmits power to the staple driver.

SUMMARY OF THE INVENTION

The present invention relates to a paper tool, such as a paper punch, a stapler, or a paper trimmer, for acting on a workpiece (e.g., a stack of sheets). In one embodiment of the invention, a paper punch includes a linkage that functions in a manner similar to a four-bar linkage to provide mechanical advantage during a punching operation, however, only two movable links are provided. By using the linkage of the present invention, the simulated pivot point of the eliminated third movable link may be placed in positions which give greater mechanical advantage but would be impractical when using a physical link. The elimination of the third movable link allows a less complex device both by reducing the number of components related to the eliminated third movable link, and also by allowing for the simplification of the paper tool as there is no longer a requirement to provide a mounting point and related structure for the eliminated third movable link.

The present invention includes a linkage having at least one pivot that provides for both rotational and translational movement between the respective coupled members. In one embodiment, such a pivot is formed by positioning a radial or an arcuate slot at one of the linkage pivots, such as the handle or cover pivots in the illustrated embodiments. The arcuate slot defines a radius, the center of which corresponds with the simulated pivot point of the eliminated third movable link. The handle or cover pivot also includes a pin or a projection received in the arcuate slot. Relative movement between the projection and the arcuate slot defines an arcuate path that simulates the constraining path or movement that would otherwise be provided by the eliminated third movable link.

Slots have been previously used in four-bar linkages and in conjunction with linkages having fewer pivot points, but these slots have not been the pivots of the linkages and have created limitations in the mechanical advantage offered. Known slots in a variety of linkages allow a sliding contact at some point within the linkage (not at a linkage pivot), so the application of force may remain at a known point. These linkages allow neither the simplification nor the mechanical advantage available when using a radial or arcuate slot at a linkage pivot and as a substitute for one of the movable links itself. The improvement is enabled by the configuration of the two remaining movable links and other structure so that the strength of the components themselves act in place of the eliminated third movable link. Thus, the linkage of the present invention delivers the full mechanical advantage of a traditional four-bar linkage with fewer physical links and pivots. Though the linkage of the present invention is first described in detail below with respect to use in a punch, it is also described and illustrated for use in a stapler to generate mechanical advantage during stapler operations. Similarly, the linkage of the present invention could be used in a paper trimmer or other paper tools. The movable pivot (i.e., the pivot that provides relative rotation and translation between the coupled members) in the linkage of the present invention could be applied to various pivots or could also be applied to more than one pivot, thereby simulating an additional movable link. This would allow a four-bar linkage to act as a five-bar linkage and so forth, generating additional mechanical advantage without the complexity of additional physical links.

The present invention provides, in one aspect, a power transmission linkage for a paper tool. The linkage includes at least three pivots connecting members of the linkage. At least one of the pivots provides both rotational and translational movement between two linkage members connected by the at least one pivot. In one embodiment, the linkage transmits power to an output member, and an engagement between the linkage and the output member occurs at a point distinct from the at least three pivots.

The present invention provides, in another aspect, a paper tool. The paper tool includes a power transmission linkage. The linkage includes a base, a drive link, an input member, and at least three pivots connecting members of the linkage. At least one of the pivots provides for both rotational and translational movement between two members connected by the at least one pivot.

The present invention provides, in yet another aspect, a paper tool including a base member, a drive link member pivotably coupled to the base member at a first pivot, and an input member pivotably coupled to the drive link member at a second pivot and pivotably coupled to the base member at a third pivot. At least one of the pivots provides for both rotational and translational movement between respective members connected by the at least one pivot.

Other features and aspects of the invention will become apparent by consideration of the following detailed description and accompanying drawings.

Figure 1:
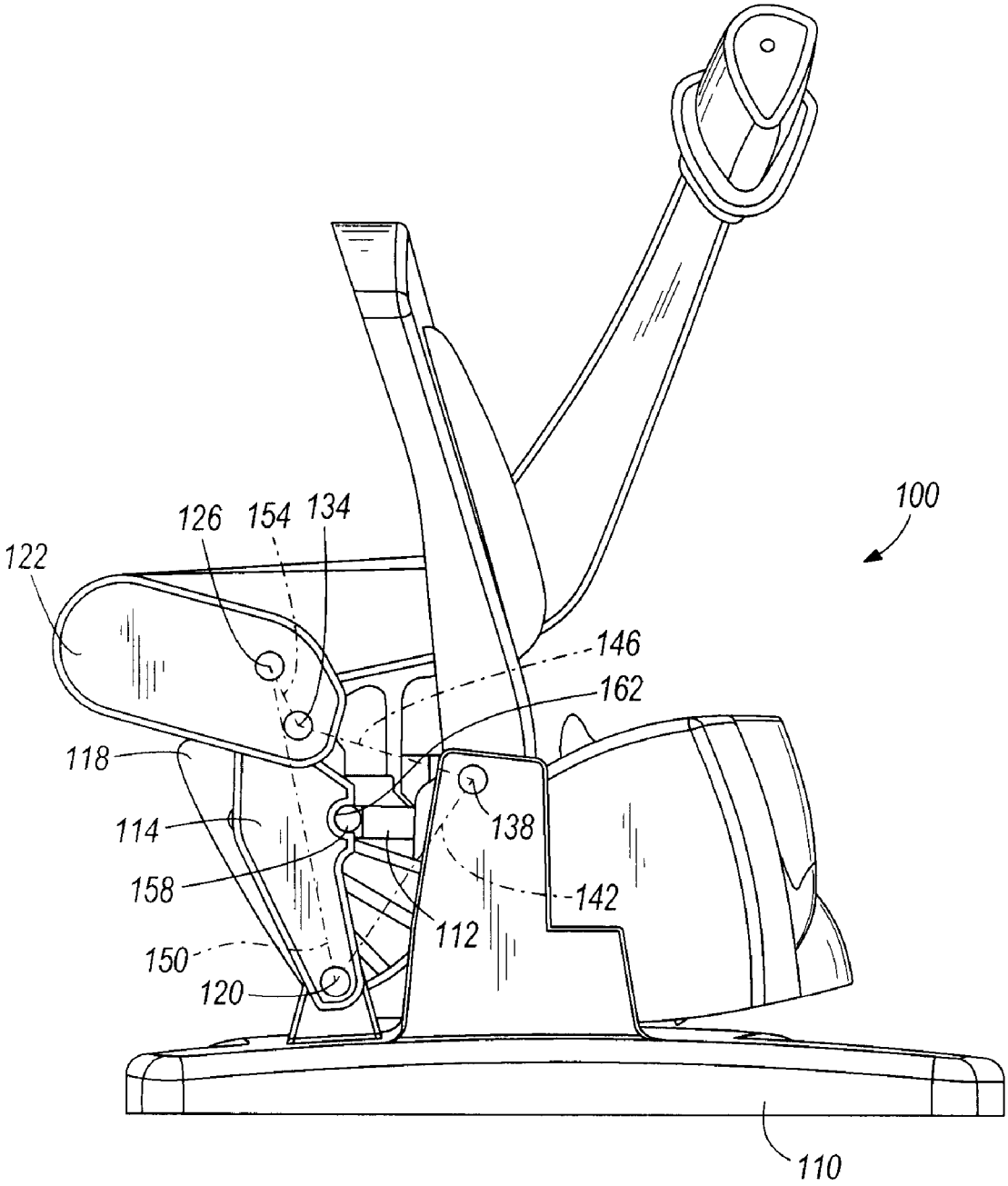
FIG. 1 PRIOR ART
FIG. 1 is a side view of a prior art paper punch utilizing a four-bar linkage.
Figure 2:
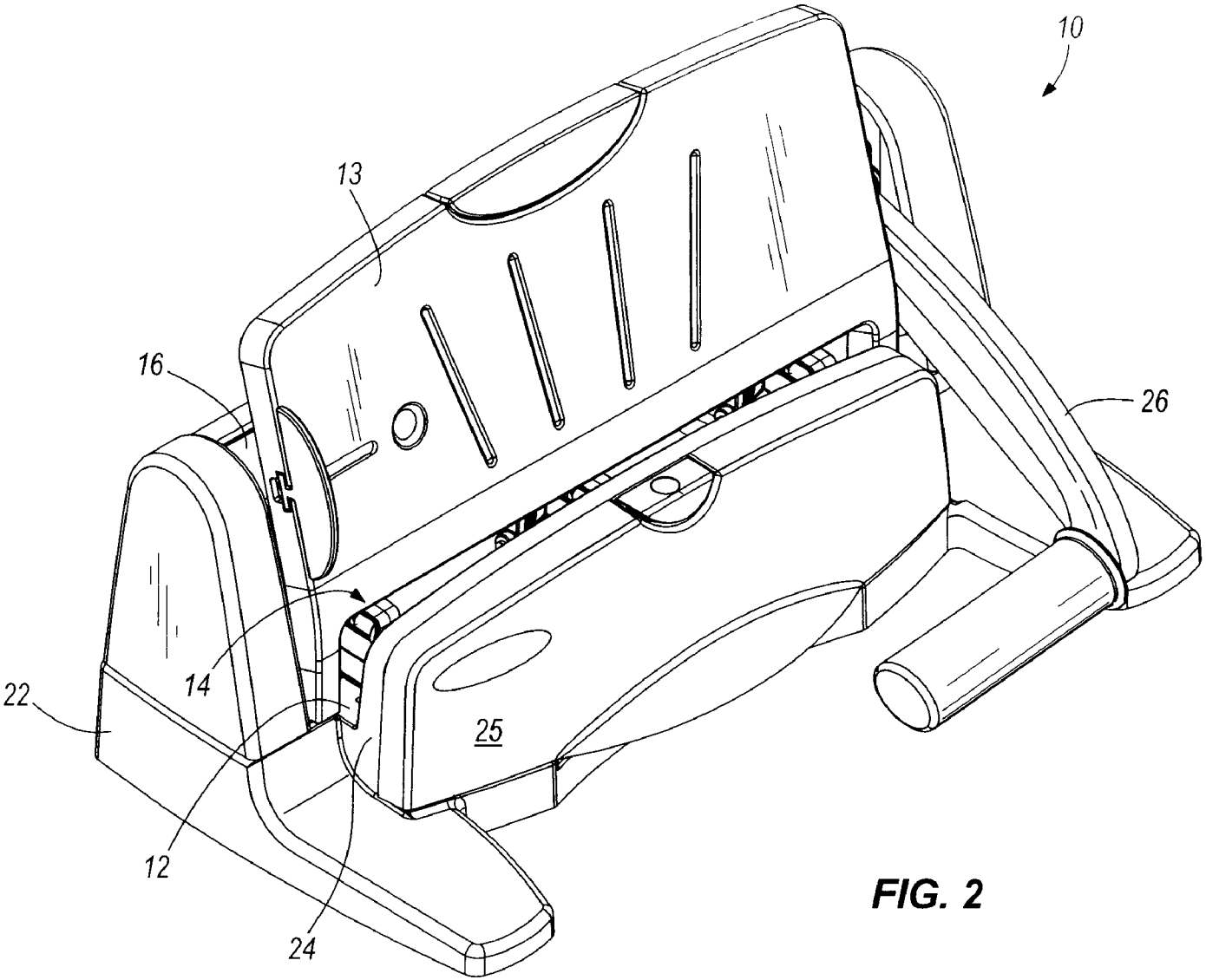
FIG. 2 is a perspective view of a paper punch according to one embodiment of the present invention.
Figure 3:
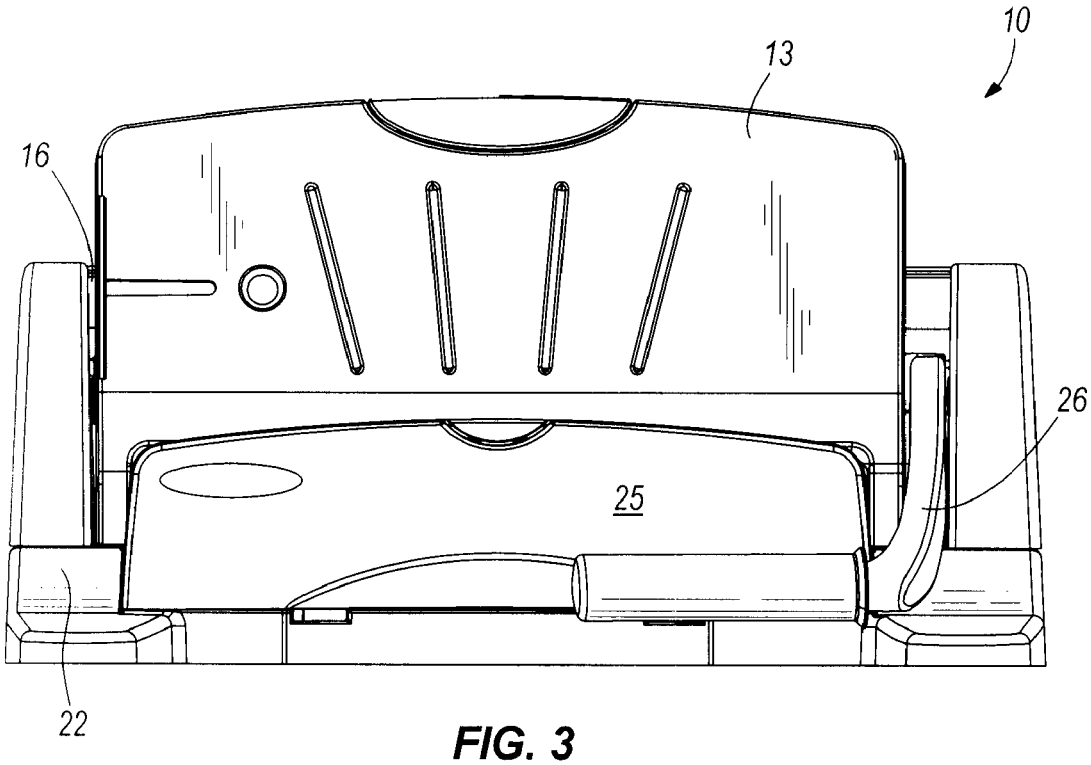
FIG. 3 is a front view of the punch of FIG. 2.
Figure 4:
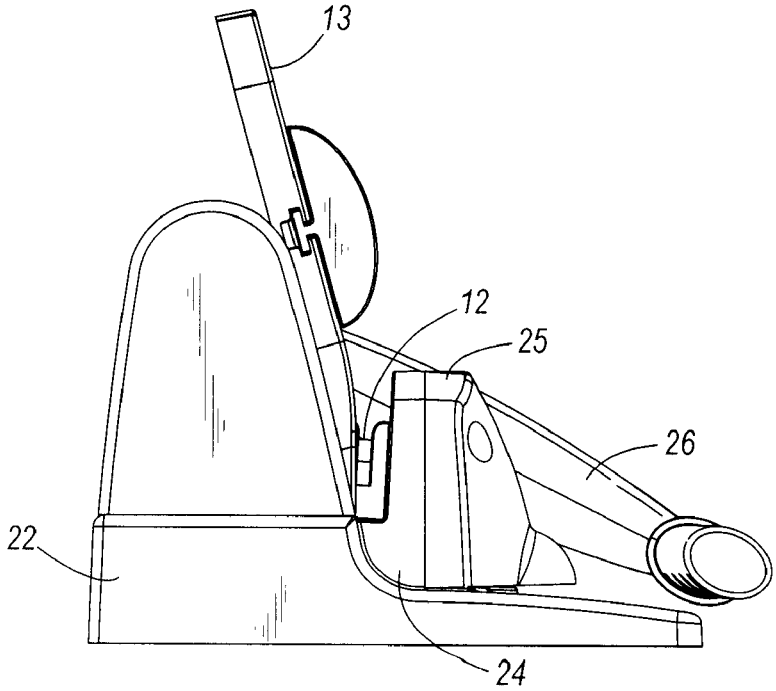
FIG. 4 is a side view of the punch of FIG. 2.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

With reference to FIGS. 2-11, a punch 10 embodying the present invention is shown. The punch 10 is preferably configured to perform a punching operation on a workpiece, such as displacing, preferably by shearing, a piece of a workpiece with respect to the remainder of the workpiece, punching a hole or stamping a depression or countersink in the workpiece, stamping to form a raised or depressed feature in a workpiece, or embossing the workpiece. Preferred workpieces for use with punches of the present invention include paper, cardboard, plastic, wood, or metal. Typically, the workpieces are in the form of one or more sheets such as a single sheet of paper or a stack of sheets of paper. In a preferred embodiment, the punch 10 is configured to punch at least one hole in a sheet of paper or stack of paper sheets, and can punch two, three, four, or more holes as desired. The punch 10 of the illustrated embodiment is configured to receive the paper within a slot 12 (see FIG. 4) in a substantially vertical configuration, though it is understood that the punch can have other configurations, including configurations permitting generally horizontal insertion of the paper. The punch 10 also includes a paper support surface 13.

As shown in FIG. 2 and FIGS. 5-11, the punch 10 includes one or more punch heads 14 configured to perform the punching operation. The punch heads 14 are protected by a punch cover 16 (see FIGS. 2 and 3). As each punch head 14 is substantially the same, only one punch head 14 will be described. The punch head 14 includes a punch pin 18 movable through a punch pin path, and a punch housing 20 that supports the punch pin 18 and through which the punch pin 18 moves (see FIGS. 5-11). Alternatively, the punch head 14 may include a die blade or plate with one or more punching elements, such as teeth or serrations, to punch the workpiece. The illustrated punch housing 20 includes an integrally formed hinge portion 21 (see FIG. 11). The punch 10 includes a base 22 (see FIGS. 2-10) configured to stably support the punch 10 on a support surface, the base 22 supporting the punch housing 20 thereon. In the illustrated construction, the punch housing 20 is secured to the base 22. In an alternative construction of the base, the punch housing 20 and/or the hinge portion 21 may be integrally formed with the base 22 as one piece.

The punch 10 also includes a handle 26 that is configured to receive force input from a user of the punch 10 and is rotatable with respect to the base 22. Alternative arrangements, such as a button or the like, may also be employed to impart the actuation motion. A motor, such as an electrical motor, or a solenoid may be also be used to impart the actuation motion. In other words, the linkage of the present invention can be incorporated in manually-operated punches like the punch 10, or in electrically-operated punches. The base 22 also includes a receiving member 24 (see FIGS. 2, 4, and 5) that is configured to receive the paper chips expelled during punching operations. The receiving member 24 includes a removable cover 25.

With reference to FIGS. 5-10, the punch 10 includes a drive linkage 64 that imparts a mechanical advantage in the punch 10 to reduce the amount of force input required from the user to operate the punch 10. The linkage 64 includes a drive link or a lever 28 associated with each punch head 14 and pivotably coupled to the base 22 at a fixed pivot 30. In the illustrated construction, the fixed pivot 30 is defined in part by the hinge portion 21 of the punch housing 20, which, in turn, is secured to the base 22. As previously stated, the punch housing 20 and/or the hinge portion 21 may be integrally formed with the base 22 as one piece, such that the pivot 30 may be located directly on the base 22.

Figure 5:
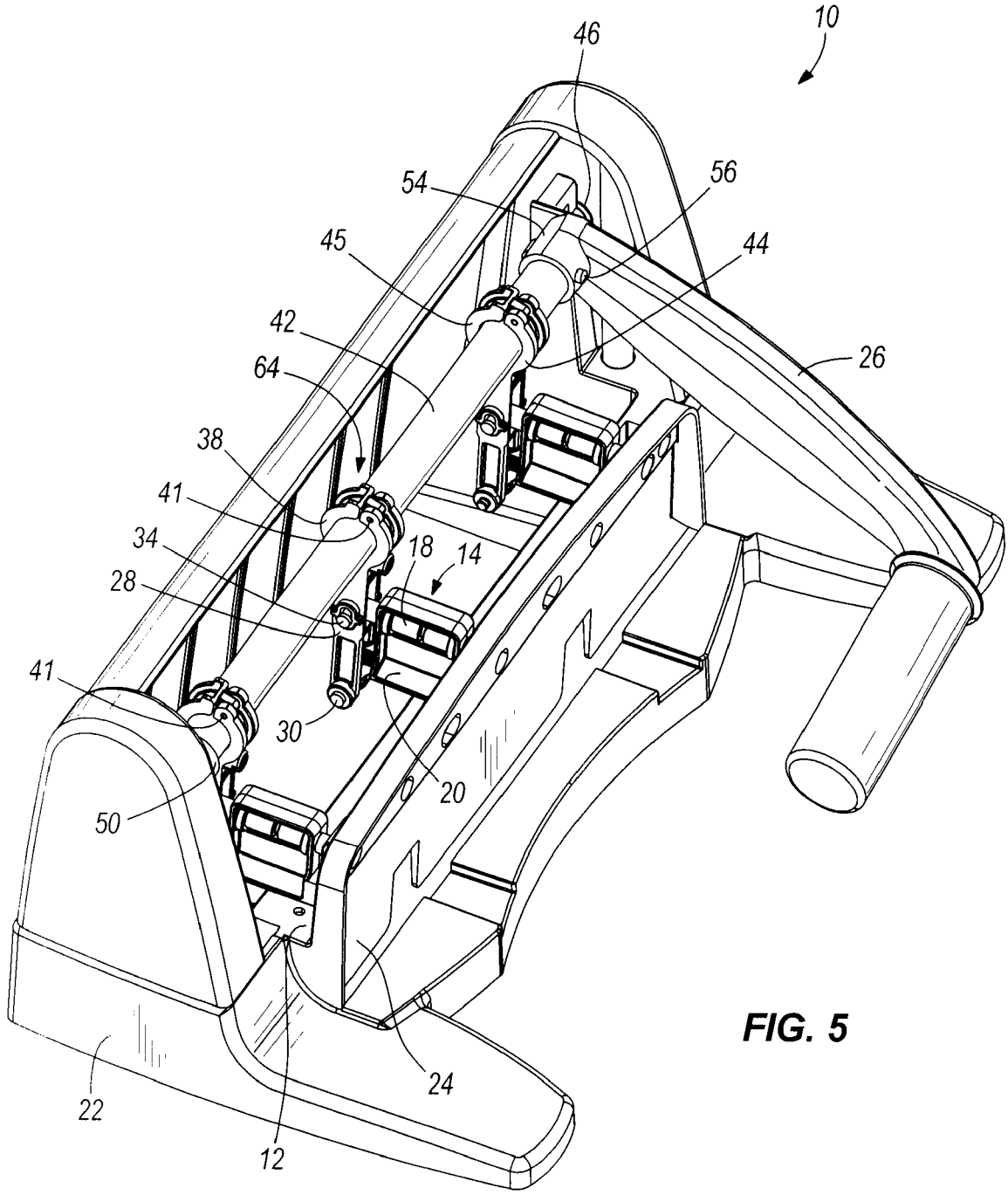
FIG. 5 is a perspective view of the punch of FIG. 2 with a punch cover removed to reveal the punching units.
Figure 6:
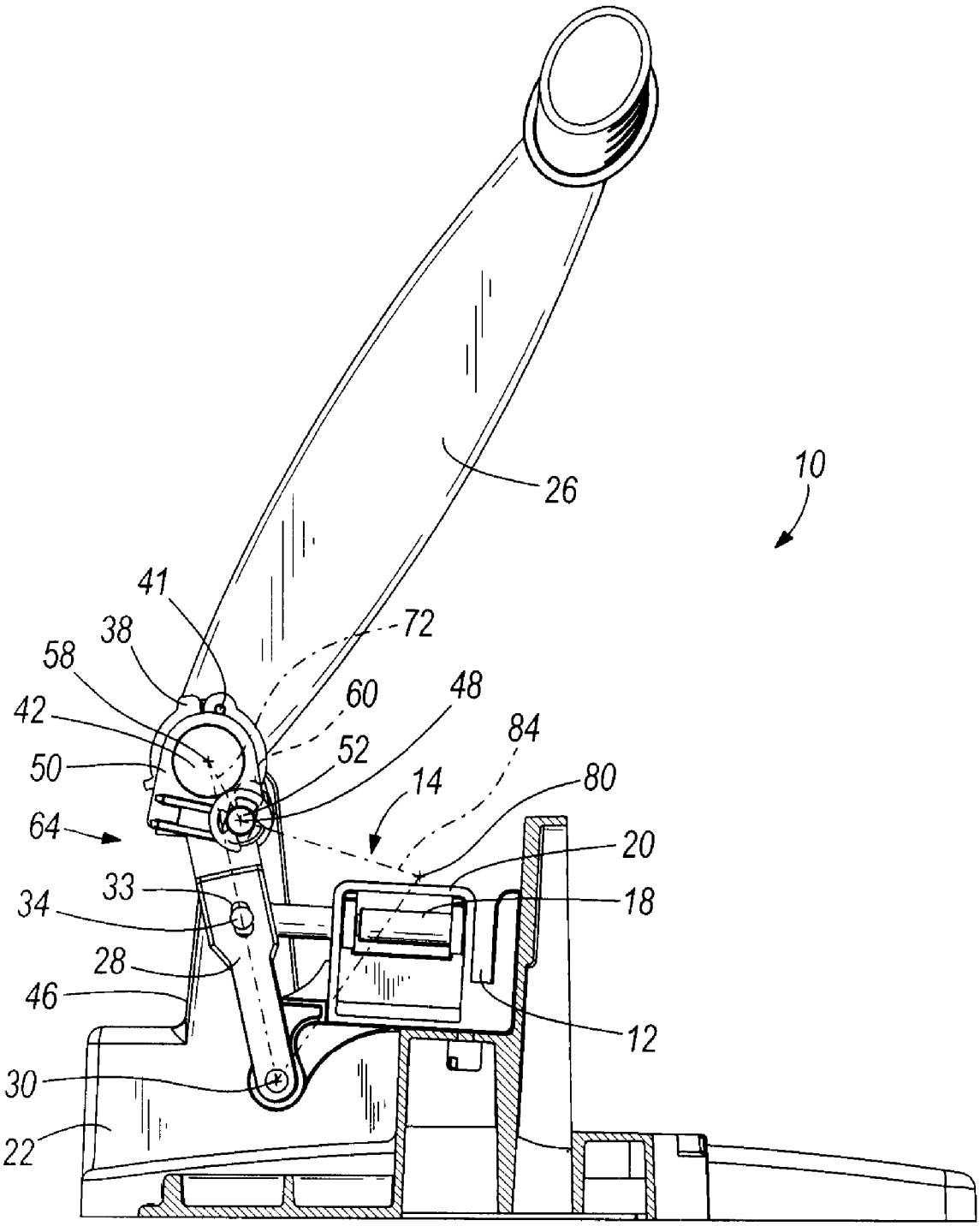
FIG. 6 is a side view, with normally hidden portions shown for clarity, of the punch of FIG. 2, illustrating a handle in an uppermost position and a punch pin in a retracted position.

The lever 28 includes an upper collar 38 that is rotationally coupled to a shaft 42 that extends along the length of the punch 10. The shaft 42 is rotatable within and at least partially supported by the collar 38 during punching. With reference to FIG. 5, a first portion 44 of the collar 38 is integrally formed with the lever 28, and a second portion 45 is pivotably coupled to the first portion 44 via a connecting pin 41. This hinged connection between the first portion 44 and the second portion 45 allows the collar 38 to be secured to and removed from the shaft 42 to facilitate changing and moving the punch heads 14 as desired.

In the illustrated construction of the punch 10, the handle 26 is coupled to the shaft 42 via an integral hub 54. A set screw or a connecting pin 56 is utilized to secure or rotationally fix the handle 26 to the shaft 42. Alternatively, the handle 26 may be coupled to the shaft 42 in any of a number of different ways, including, among others, integrally forming the handle 26 and the shaft 42. The shaft 42 is loosely supported within the collars 38 so as to form another pivot 58 (see FIGS. 6-10) of the linkage 64, via the shaft 42 being allowed to rotate freely within the collars 38.

With reference to FIGS. 5-10, the punch 10 includes vertical uprights 46 (only one is shown) coupled to the base 22. The vertical uprights 46 define a portion of yet another pivot 48 of the linkage 64. In the illustrated embodiment, each pivot 48 includes an aperture in the form of a radial or an arcuate slot 60 defined in each vertical upright 46 on each side of the punch 10, and a projection or a pin 52 received within the slot and both rotatably and translationally movable relative to the slot 60. Alternative constructions of the linkage may include an aperture having any of a number of different configurations, provided that the projection or pin 52 be allowed to both rotate and translate relative to the aperture to define a generally arcuate path of relative movement between the components defining the pivot 48. Other geometries that provide relative rotation and translation without using apertures and projections can also be substituted (e.g., slider arrangements, channel arrangements, and the like). In yet other embodiments, the path of relative movement between the components defining the pivot need not be arcuate, yet will still allow the relative rotational and translational movement between the components defining the pivot, and ultimately between the links coupled together at the pivot.

In the illustrated construction of the linkage 64, one of the pins 52 is coupled to a collar 50 (see FIG. 5) mounted on one end of the shaft 42, and the other pin 52 is coupled to the integral hub 54 at the other end of the shaft 42. During operation of the punch 10, the handle 26 pivots about the pins 52, which move within their respective slots 60 along an arcuate path during rotation of the handle 26. Thus, the pivot 48 is not a typical pivot in which a pin rotates within an aperture configured to permit rotation but to generally prevent any other relative movement of the pin (like the pivots 30 and 58), but rather is a movable pivot or a pivot defined by components that undergo relative translational movement.

In an alternative construction of the punch 10, the slot 60 can be defined in structure associated with the handle 26 (e.g., in the hub 54 or collar 50) and the pins 52 can be on the vertical uprights 46 or other portions of the base 22. In other words, the components that define the pivot 48 can be reversed from the illustrated construction without changing the operation of the pivot 48 or the linkage 64.

In yet another alternative construction of the punch 10 and the linkage 64, the fixed pivot 30 and the moving pivot 48 could be reversed such that the pivot defined between the lever 28 and the base 22 (e.g., via the hinge portion 21 of the punch housing 20) could include an aperture and a projection movable relative to the aperture (e.g., in an arcuate path) in the manner discussed above for the pivot 48. In this case, the pivot 48 could remain as discussed above, or could be a typical pivot with the pins 52 pivoting within an aperture sized to allow substantially only rotation of the pins 52 therein. In yet other alternative applications of the linkage 64, the pivot 58 could define the movable pivot. Therefore, the illustrated punch 10 provides a linkage 64 for a paper punch including a base member 22 and a drive link member in the form of lever 28 pivotably coupled to the base 22 (e.g., via the hinge portion 21 of the punch housing 20) at a first pivot 30. An input member in the form of handle 26 is pivotably coupled to the drive link (e.g., via the collars 38) at a second pivot 58. The input member or handle 26 is also pivotably coupled to the base 22 (e.g., via vertical uprights 46) at a third pivot 48. At least one of the pivots provides both pivotal (i.e., rotational) and translational movement between the respective members upon movement of the input member. In other embodiments, there could be additional linkage members and additional pivots, however, at least one of the pivots would still provide both pivotal (i.e., rotational) and translational movement between the respective members.

Figure 11:
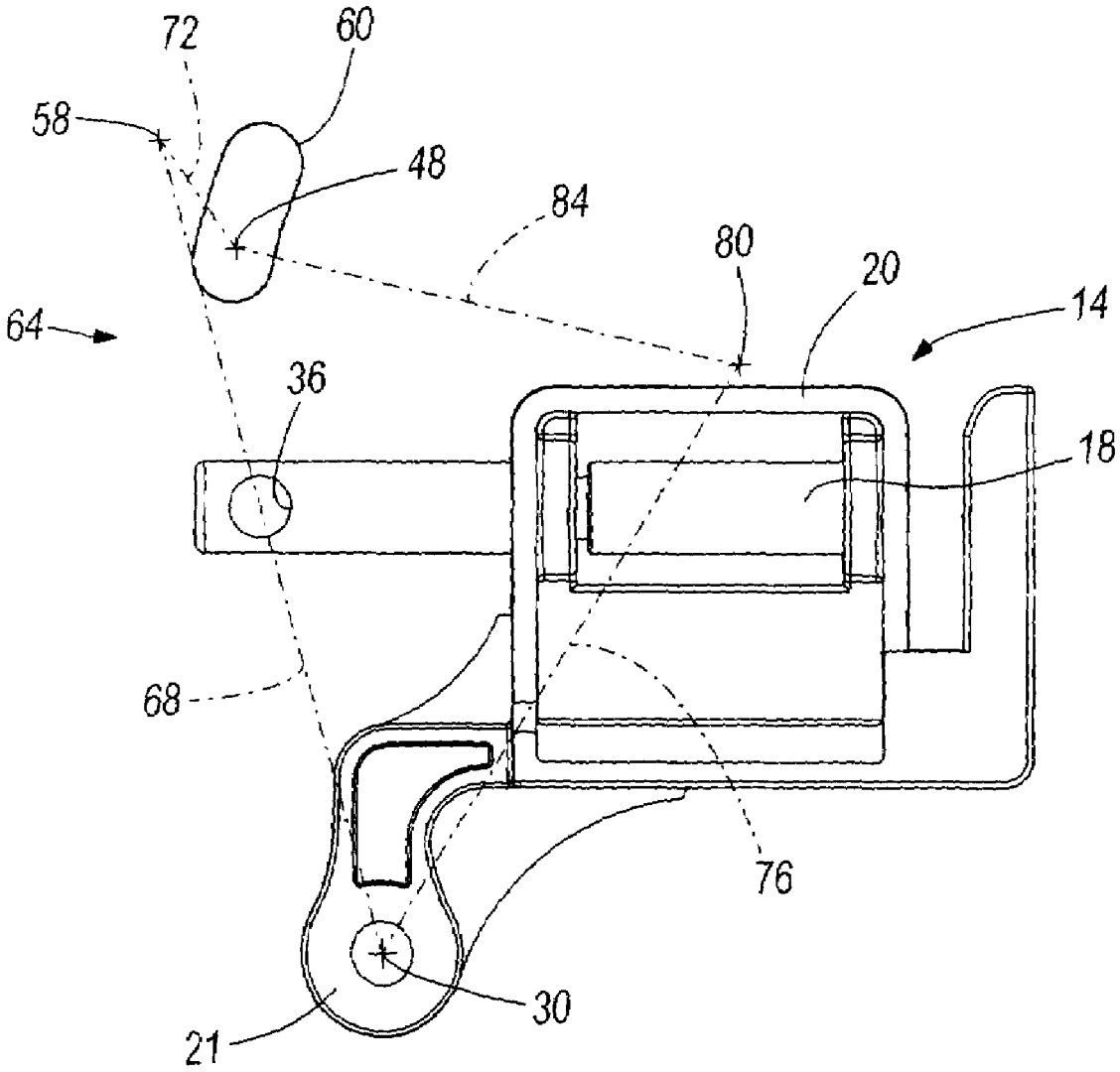
FIG. 11 is a schematic view of a linkage for driving a punch pin of the punch of FIG. 2.

With reference to FIGS. 5-10, a connecting pin 34 may be used to connect the lever 28 to the punch head 14 such that action upon the lever 28 results in action upon the punch pin 18. As shown in FIG. 11, the punch pin 18 includes an aperture 36 through which the connecting pin 34 is inserted to connect the lever 28 and the punch pin 18. The lever 28 includes a slot 33 in which the connecting pin 34 slides when the lever 28 is rocked or pivoted about pivot 30. The sliding contact between the connecting pin 34 and the slot 33 helps to maintain the application of force to the punch pin 18 at a known point and in the required direction. The purpose of such sliding contact is distinct from the sliding contact that may occur at the pivot 48 in the linkage 64, which is not to apply a consistently directed force to an output member, but rather is to create an improved linkage pivot that can eliminate a physical link and its associated physical pivot, while simulating the motion of the linkage as if that physical link and its associated physical pivot were not eliminated.

FIG. 11 schematically illustrates the linkage 64 of the invention in terms of a force diagram that will be understood by one of skill in the art to represent a four bar linkage. Thus, the "bars" defined below do not necessarily relate to a physical structure, but rather refer to the "bars" of the linkage in the force diagram. The drive linkage 64 includes a first bar 68 that extends between the pivot 58 and the fixed pivot 30. In the illustrated punch 10, this first bar is the lever 28. A second bar 72 extends between the pivot 58 and the pivot 48. In the illustrated punch 10, this second bar 72 is defined by the hub 54 and collar 50. A fixed or ground bar 76 extends between the pivot 30 and a fixed point 80, as shown in FIG. 11. This fixed point 80 defines the center of rotation of the arc defined by the arcuate slot 60. There is no physical link associated with the ground bar 76 except for the inherent structure and strength of the base 22. Furthermore, there is no physical link associated with a third bar 84 extending between the fixed point 80 and the pivot 48. Instead, the configuration of the pivot 48 (i.e., its ability to translate in addition to rotate), and the strong construction of the punch 10 components allows the linkage 64 to function in a similar manner to a four bar linkage, but allows eliminating a physical link and a physical pivot typically associated with a four bar linkage. By eliminating this physical link and physical pivot, there is greater flexibility in configuring the punch, but the mechanical advantage obtained with a four bar linkage is maintained.

Figure 7:
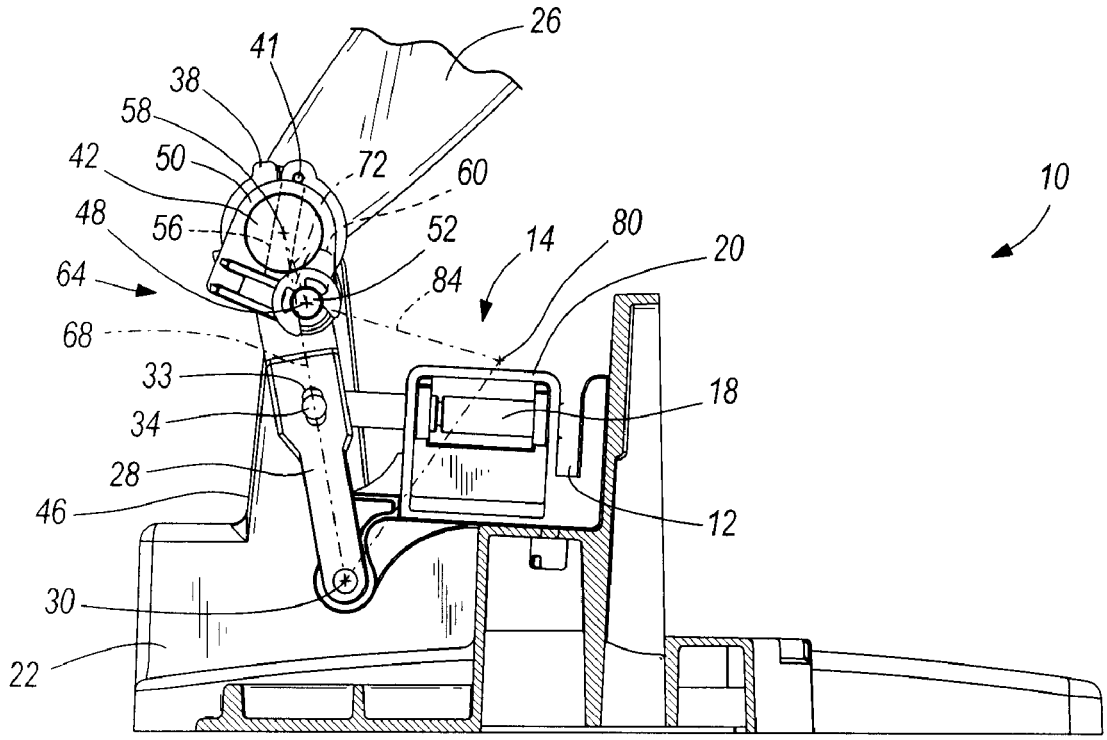
FIG. 7 is an enlarged view of FIG. 6.

FIGS. 7-10 illustrate the relative motion of the components discussed above as the punch is actuated. For discussion purposes, motion from left to right will be discussed below from the perspective of the punch as viewed in FIGS. 7-10. FIG. 7 illustrates the punch 10 in the rest position. In the rest position, the first bar 68 is located to the left of the second bar 72, and the second bar 72 forms an obtuse angle with respect to the eliminated third bar 84.

Figure 8:
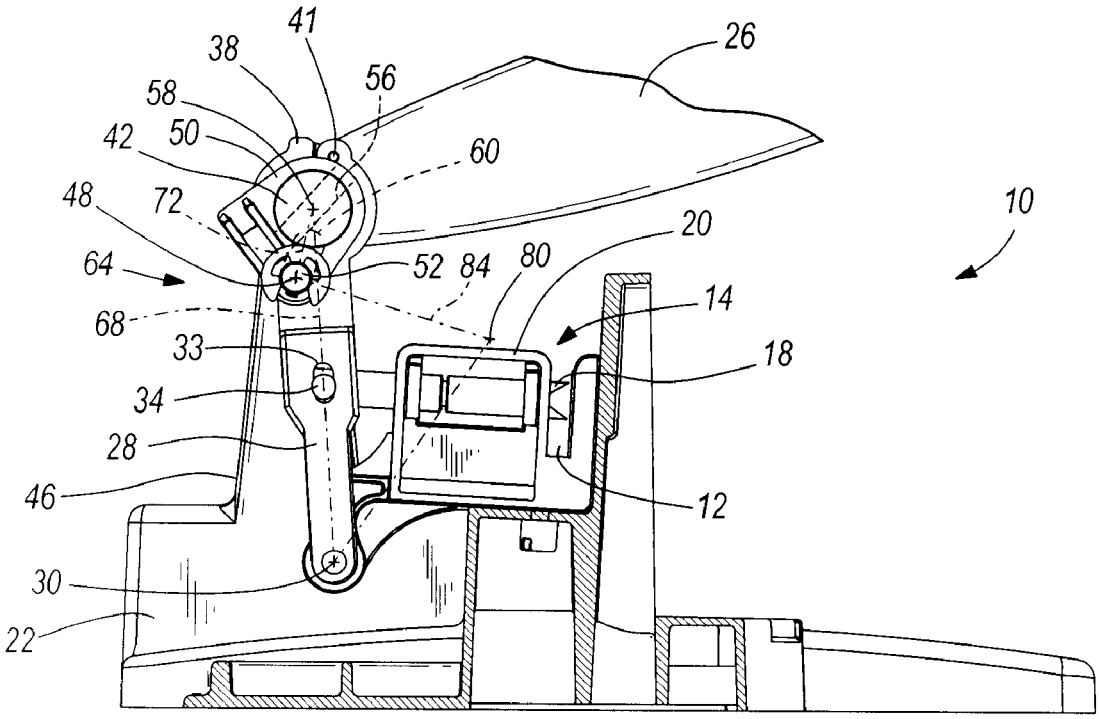
FIG. 8 is a view similar to that of FIG. 7, illustrating the handle pivoted downwardly and the punch pin partially extended.

As the handle 26 is rotated, as shown in FIG. 8, the shaft 42 rotates with the hub 54 and collar 50 such that the second bar 72 is now substantially vertical, and the first bar 68 (i.e., the lever 28) moves to the right of the second bar 72. The motion of the lever 28 due to rotation of the handle 26 and the fixed position of the pivot point 30 moves the connecting pin 34 and the punch pin 18 out of the punch housing 20 toward the slot 12. The pivot pin 52 begins to translate (i.e., slide) up the slot 60, while also rotating within the slot 60.

Figure 9:
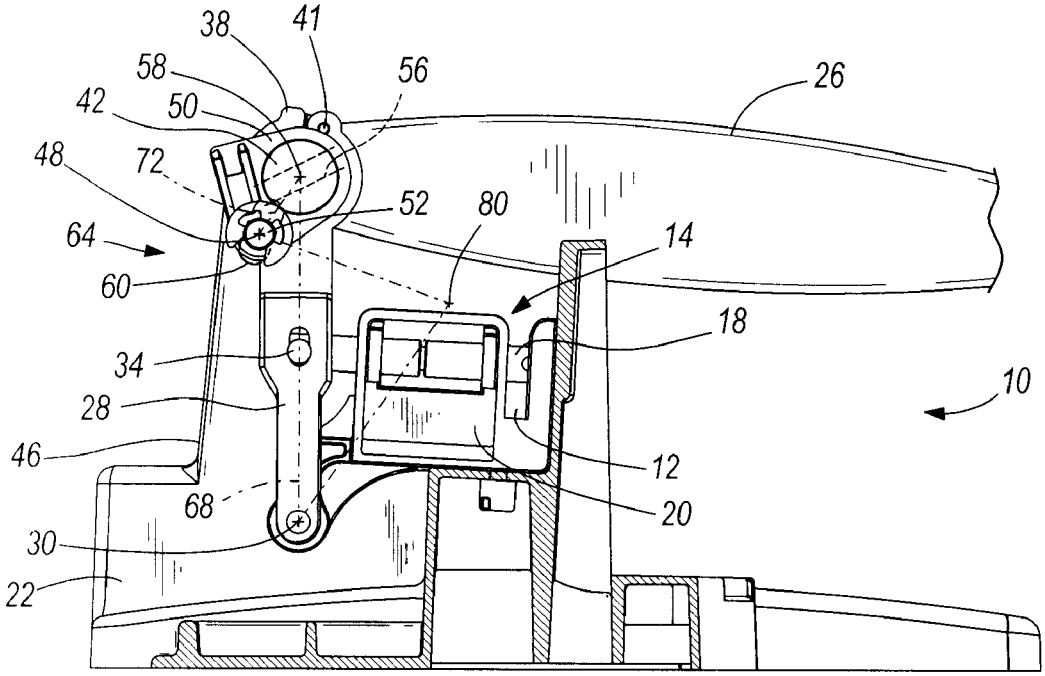
FIG. 9 is a view similar to that of FIG. 8, illustrating the handle pivoted further downwardly and the punch pin extended further.
Figure 10:
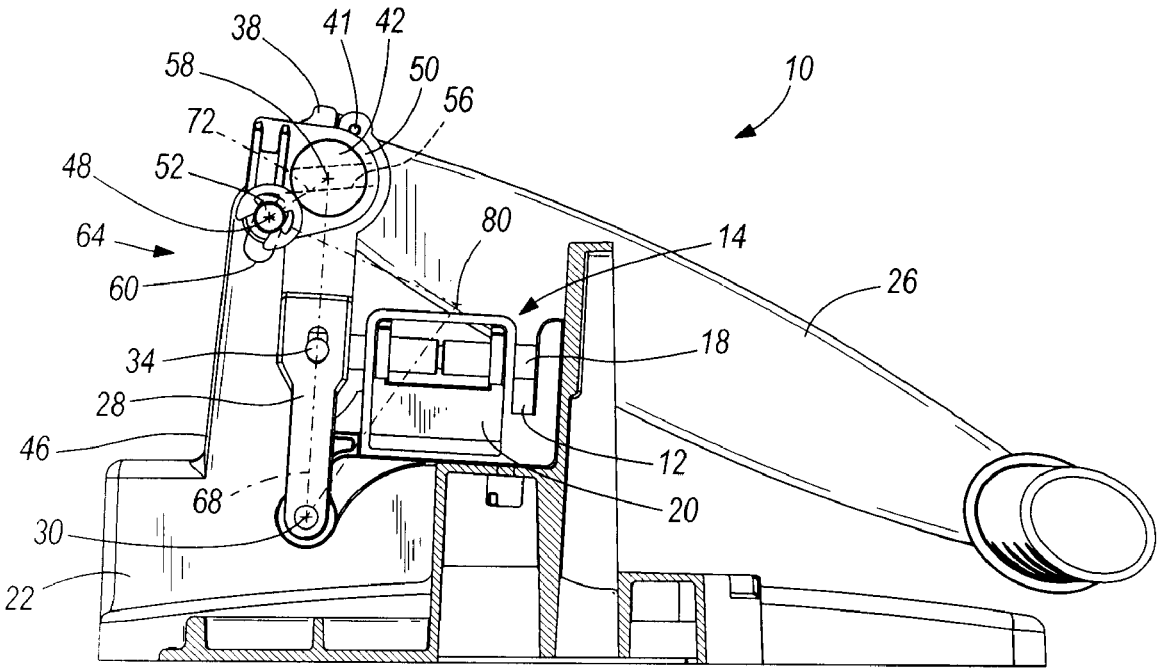
FIG. 10 is a view similar to that of FIGS. 7-9, illustrating the handle in a lowermost position and the punch pin fully extended.

As shown in FIG. 9, continued rotation of the handle 26 moves the lever 28 such that the lever 28, and thus the first bar 68, are substantially vertical. The pivot pin 52 slides further in the slot 60, while also rotating, and the second bar 72 forms an acute angle with respect to the invisible bar 84. The punch pin 18 continues to move into the slot 12. As the handle 26 reaches the bottom of its rotational path, shown in FIG. 10, the pivot pin 52 has reached the uppermost point of travel within the slot 60. The punch pin 18 is fully extended through the slot 12 and through apertures in the receiving member 24. When paper is punched by the punch pin 18, the pieces of paper punched out of the sheet, commonly called chads, fall into a collection space between the receiving member 24 and the removable cover 25.

As the user releases the handle 26, a spring (not shown) seated in a groove 88 (see FIG. 8) in the punch pin 18 biases the punch pin 18 against the lever 28. The bias of the spring, through the drive linkage 64, returns the punch 10 to the rest position. In cases of a jam, the handle 26 can be manually lifted to move the punch pin 18, and thus the other punch components, back to rest.

FIGS. 12-15 illustrate a stapler 200 incorporating an embodiment of the improved drive linkage 204 of the present invention. The illustrated stapler 200 is a manually-activated, potential energy style stapler of the type generally described in pending U.S. application Ser. No. 11/424,618, filed Jun. 16, 2006, the entire content of which is hereby incorporated by reference (hereinafter the '618 application). For clarity in viewing the drive linkage 204, some internal structure of the stapler 200 has been removed. However, it is understood that the linkage 204 of the present invention can also be incorporated for use in other potential energy style staplers, in non-potential energy style staplers, and in electric staplers driven by an electric motor or a solenoid.

The stapler 200 includes a body portion that, for the purposes of consistency with the above discussion of the linkage 64 used in the punch 10, will be referred to hereinafter as the base 208. The base 208 includes the magazine 210 that houses the staples.

A drive link 214 is pivotably connected to the base 208 at pivot 218. In the illustrated stapler 200, bosses or a pin 222 (i.e., a projection) on the base 208 are received in an aperture 226 (see FIG. 15) on the drive link 214 to define the pivot 218. Alternatively, the bosses or pin 222 could be on the drive link 214 and the apertures could be formed in the base 208. The illustrated pivot 218 is a typical pivot in that the bosses or pin 222 are allowed to rotate in the aperture 226, but cannot substantially translate or otherwise move relative to the aperture 226. The drive link 214 supports a spring 230 that is deflected during stapler operation to store energy. An end of the spring is slidably received in an aperture 232 in the staple driver 234 so that when the stored energy in the spring 230 is released, the driver 234 is moved downwardly to drive a staple from the base 208. The details of the energy storage and energy release with the spring 230 are fully described in the '618 application and need not be described here in detail. Only the construction and operation of the linkage 204 is discussed in detail herein.

The stapler 200 further includes a cover 238 acting as the input member of the linkage 204. The cover 238 is pivotably coupled to the drive link 214 at pivot 242. Any suitable arrangement can be used to achieve the pivot 242, such as bosses or a pin 246 in one of the cover 238 and the drive link 214 being received in an aperture or apertures 250 in the other of the cover 238 and the drive link 214. Like the pivot 218, the illustrated pivot 242 is a typical pivot in that the bosses or pin 246 are allowed to rotate in the aperture 250, but cannot substantially translate or otherwise move relative to the aperture 250.

Figure 12:
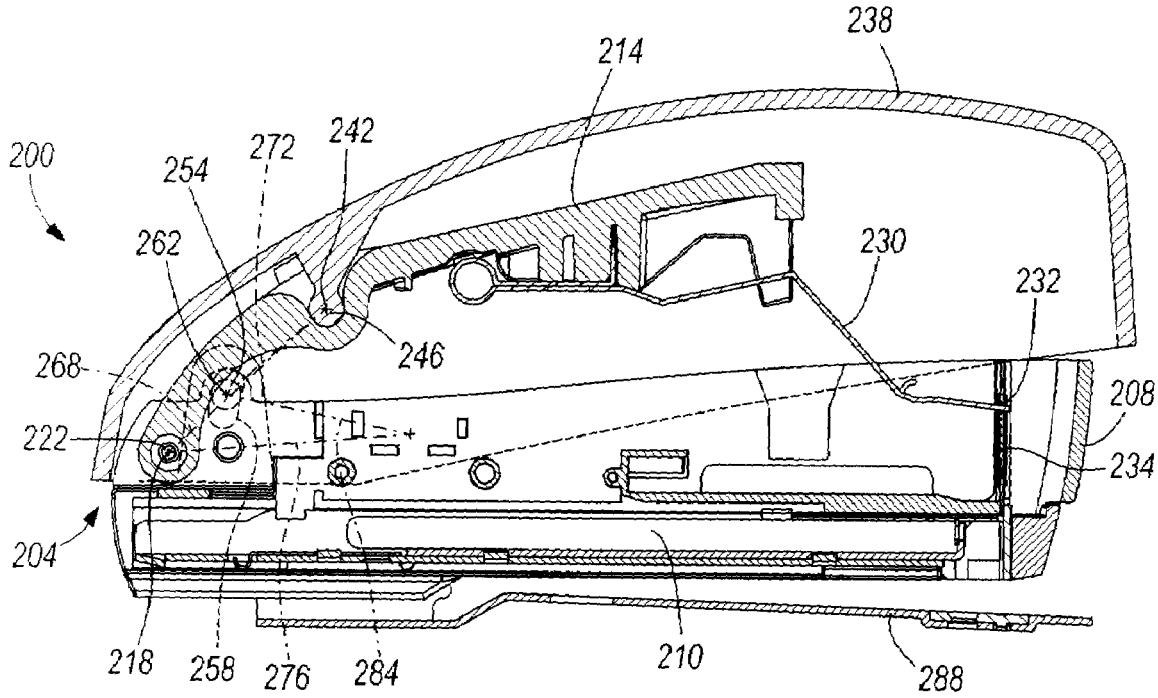
FIG. 12 is a side view, with normally hidden portions shown for clarity, of a stapler according to another embodiment of the present invention, illustrating an stapler cover in an uppermost position and a staple driver in a retracted position.
Figure 13:
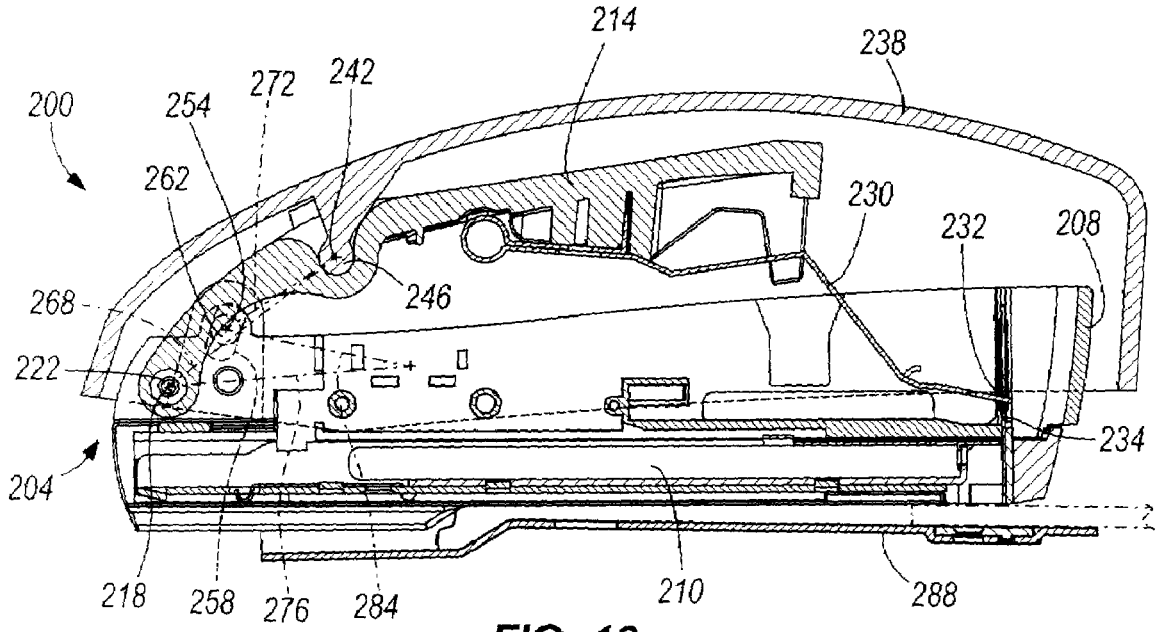
FIG. 13 is a view similar to that of FIG. 12, illustrating the stapler cover pivoted downwardly and the staple driver extended.
Figure 14:
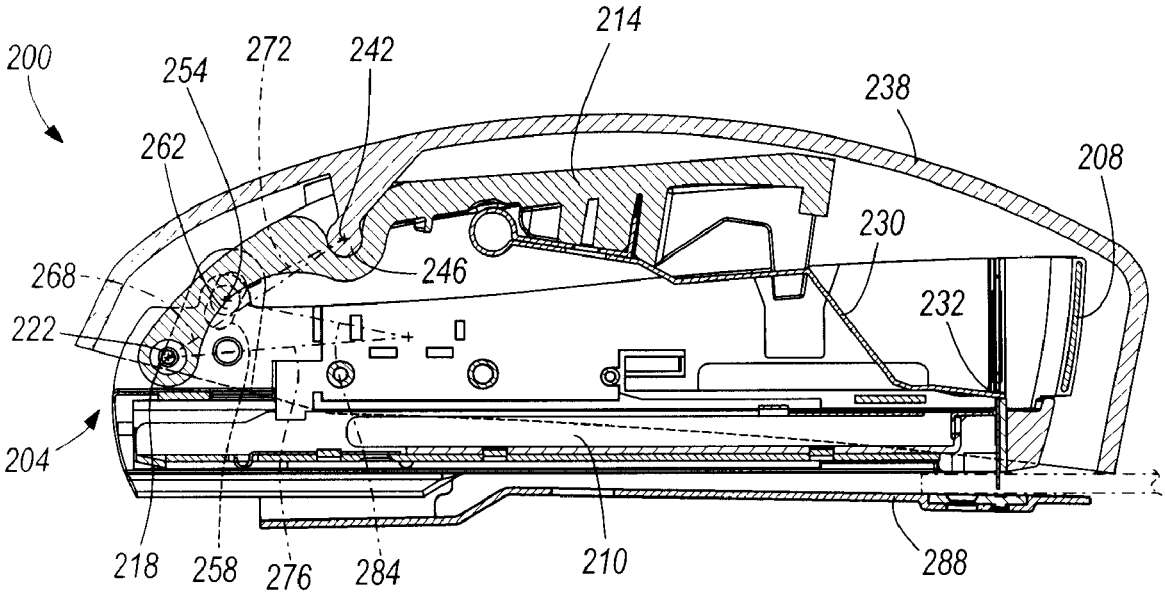
FIG. 14 is a view similar to that of FIGS. 12 and 13, illustrating the stapler cover in a lowermost position.

The cover 238 is also pivotably coupled with the base 208 at pivot 254. In the illustrated stapler 200, the pivot 254 is defined in part by one or more apertures in the form of radial or arcuate slots 258 formed in or with a portion of the cover 238. Bosses or a pin 262 on the base 208 are received in the slots and are both rotatably and translationally movable relative to the slots 258. As shown in FIGS. 12-14, the bosses or pin 262 are fixed relative to the base 208 and movement of the handle 238 causes the slots 258 to move along an arcuate path relative to the bosses or pin 262 as the handle 238 is depressed. Alternative constructions of the linkage 204 may include an aperture having any of a number of different configurations, provided that the bosses or pin 262 be allowed to both rotate and translate relative to the aperture to define a generally arcuate path of relative movement between the components defining the pivot 254. Other geometries that provide relative rotation and translation without using apertures and projections can also be substituted (e.g., slider arrangements, channel arrangements, and the like). In yet other embodiments, the path of relative movement between the components defining the pivot need not be arcuate, yet will still allow the relative rotational and translational movement between the components defining the pivot, and ultimately between the links coupled together at the pivot. Thus, the pivot 254 is not a typical pivot in which a pin or boss rotates within an aperture configured to permit rotation but to generally prevent any other relative movement of the pin or boss (like the pivots 218 and 242), but rather is a movable pivot or a pivot defined by components that undergo relative translational movement.

In an alternative construction of the stapler 200, the slots 258 can be defined in structure associated with the base 208 and the bosses or pin 262 can be on the handle 238. In other words, the components that define the pivot 254 can be reversed from the illustrated construction without changing the operation of the pivot 254 or the linkage 204.

In yet another alternative construction of the stapler 200 and the linkage 204, the fixed pivot 218 and the moving pivot 254 could be reversed such that the pivot defined between the drive link 214 and the base 208 could include an aperture and a projection movable relative to the aperture (e.g., in an arcuate path) in the manner discussed above for the pivot 254. In this case, the pivot 254 could remain as discussed above, or could be a typical pivot with the bosses or pin 262 pivoting within an aperture sized to allow only rotation of the bosses or pin 262 therein. In yet other alternative applications of the linkage 204, the pivot 242 could define the movable pivot. Therefore, the illustrated stapler 200 provides a linkage 204 for a stapler including a base member 208 and a drive link member 214 pivotably coupled to the base member 208 at a first pivot 218. An input member in the form of cover 238 is pivotably coupled to the drive link member 214 at a second pivot 242. The input member or cover 238 is also pivotably coupled to the base member 208 at a third pivot 254. At least one of the pivots provides both pivotal (i.e., rotational) and translational movement between the respective members upon movement of the input member. In other embodiments, there could be additional linkage members and additional pivots, however, at least one of the pivots would still provide both pivotal (i.e., rotational) and translational movement between the respective members.

The sliding contact between the spring 230 on the drive link 214 and the aperture 232 in the driver 234 helps to maintain the application of force to the driver 234 at a known point and in the required direction. The purpose of such sliding contact is distinct from the sliding contact that may occur at the pivot 254 in the linkage 204, which is not to apply a consistently directed force to an output member, but rather is to create an improved linkage pivot that can eliminate a physical link and its associated physical pivot, while simulating the motion of the linkage as if that physical link and its associated physical pivot were not eliminated.

Figure 15:
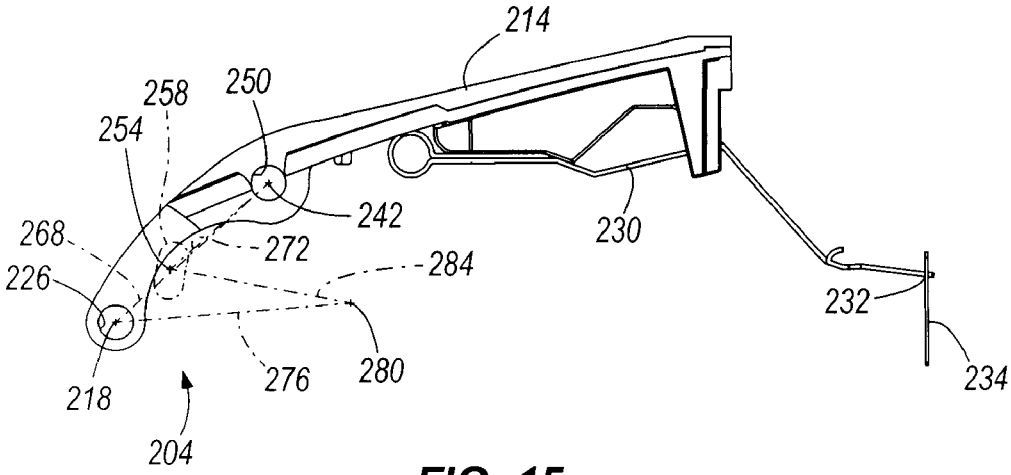
FIG. 15 is a schematic view of a linkage for driving the staple driver of the stapler of FIG. 12.

FIG. 15 schematically illustrates the linkage 204 of the invention in terms of a force diagram that will be understood by one of skill in the art to represent a four bar linkage. Thus, the "bars" defined below do not necessarily relate to a physical structure, but rather refer to the "bars" of the linkage in the force diagram. The drive linkage 204 includes a first bar 268 that extends between the pivot 242 and the fixed pivot 218. In the illustrated stapler 200, this first bar is the drive link 214. A second bar 272 extends between the pivot 242 and the pivot 254. In the illustrated stapler 200, this second bar 272 is defined by structure of the cover 238. A fixed or ground bar 276 extends between the pivot 218 and a fixed point 280, as shown in FIG. 15. This fixed point 280 defines the center of rotation of the arc defined by the arcuate slots 258. There is no physical link associated with the ground bar 276 except for the inherent structure and strength of the base 208. Furthermore, there is no physical link associated with a third bar 284 extending between the fixed point 280 and the pivot 254. Instead, the configuration of the pivot 254 (i.e., its ability to translate in addition to rotate), and the strong construction of the stapler 200 components allows the linkage 204 to function in a similar manner to a four bar linkage, but allows eliminating a physical link and a physical pivot typically associated with a four bar linkage. By eliminating this physical link and physical pivot, there is greater flexibility in configuring the stapler, but the mechanical advantage obtained with a four bar linkage is maintained.

The linkage 204 operates in a similar manner to the linkage 64 discussed above with respect to punch 10. Therefore, the operation of the linkage 204 will not be described in further detail.

The stapler 200 further includes an anvil plate 288 pivotably coupled to the base 208. This anvil plate 288 includes an anvil for bending the legs of the staples, as is well known in the art. The anvil plate 288 can include an overmolded or otherwise-applied surround (not shown) to complete the stapler. In the illustrated stapler 200, the anvil plate 288 and any surrounding structure is not part of the drive linkage 204.

Various features of the invention are set forth in the following claims.

What is claimed is:

1. A paper tool comprising:

a base member;

a drive link member pivotably coupled to the base member at a first pivot; and an input member pivotably coupled to the drive link member at a second pivot and pivotably coupled to the base member at a third pivot;

wherein the third pivot provides for both rotational and translational movement between respective members connected by the third pivot, and the first pivot is a fixed pivot providing for rotational movement without translational movement between respective members connected thereby.

2. The paper tool of claim 1, wherein the third pivot includes an aperture and a projection received in and both rotationally and translationally movable relative to the aperture.

3. The paper tool of claim 2, wherein the aperture is an arcuate slot.

4. The paper tool of claim 2, wherein the aperture is defined in the base member, and the projection is coupled to the input member, the projection received in and movable relative to the aperture to couple the input member and the base member.

5. The paper tool of claim 1, further comprising an output member coupled to the drive link member and movable in response to movement of the drive link member.

6. The paper tool of claim 5, wherein the input member includes a handle, and wherein the output member includes a punch pin.

7. The paper tool of claim 6, further comprising a punch housing secured to the base member for supporting the punch pin, and wherein the first pivot is formed with the punch housing.

8. The paper tool of claim 5, wherein the input member includes a stapler cover, and wherein the output member includes a staple driver.

9. The paper tool of claim 1, wherein the base member includes a stapler magazine, and wherein the input member includes a stapler cover.

10. The paper tool of claim 1, wherein the paper tool is a stapler.

11. A stapler comprising:

a base member;

a drive link member;

a staple driver coupled to the drive link member; and an input member including a stapler cover and being pivotably coupled to the drive link member, the input member configured to receive an input force and transmit the input force to the drive link member for driving movement of the drive link member and the staple driver relative to the base member;

wherein one of the drive link member and the input member has a pivot that is movable along an arcuate path relative to the base member.

12. The stapler of claim 11, wherein the other of the drive link member and the input member is coupled to the base member with a fixed pivot.

13. The stapler of claim 11, wherein the pivot that is movable along an arcuate path relative to the base member includes an aperture and a projection received in and both rotationally and translationally movable relative to the aperture.

14. The stapler of claim 13, wherein the aperture is defined in the base member.

15. The stapler of claim 13, wherein the aperture is an arcuate slot.

16. The stapler of claim 11, wherein the base member includes a stapler magazine.

17. The stapler of claim 11, wherein the pivot that is movable along an arcuate path relative to the base member couples the input member and the base member.

18. A paper tool comprising:

a base member;

a drive link member pivotably coupled to the base member at a first pivot; and an input member pivotably coupled to the drive link member at a second pivot and pivotably coupled to the base member at a third pivot;

wherein the third pivot provides for both rotational and translational movement between the input member and the base member, and wherein the third pivot includes an arcuate slot defined in one of the base member and the input member, and a projection coupled to the other of the base member and the input member, the projection received in and movable relative to the arcuate slot to couple the input member and the base member.

19. The paper tool of claim 18, further comprising an output member coupled to the drive link member and movable in response to movement of the drive link member, the output member including a staple driver.

20. The paper tool of claim 18, wherein the base member includes a stapler magazine, and wherein the input member includes a stapler cover.

21. The paper tool of claim 18, wherein the paper tool is a stapler.

22. The paper tool of claim 18, further comprising an output member coupled to the drive link member and movable in response to movement of the drive link member, the output member including a punch pin.

23. A stapler movable between a rest position, in which no force is input to the stapler by a user, and a stapling position in which a staple is ejected from the stapler, the stapler comprising:

a base member;

a drive link member pivotably coupled to the base member at a first pivot;

a staple driver coupled to the drive link member;

a staple magazine configured to hold a plurality of staples for sequential ejection by the staple driver; and an input member pivotably coupled to the drive link member at a second pivot and pivotably coupled to the base member at a third pivot;

wherein one of the first and third pivots provides for both rotational and translational movement between respective members connected by the one pivot, and wherein the staple driver is positioned entirely above staples held in the staple magazine when the stapler is in the rest position.

24. The stapler of claim 23, wherein the other one of the first and third pivots is a fixed pivot providing for rotational movement without translational movement between respective members connected thereby.

25. The stapler of claim 23, wherein the pivot that provides for both rotational and translational movement is the third pivot.

26. The stapler of claim 23, wherein the pivot that provides for both rotational and translational movement includes an aperture and a projection received in and both rotationally and translationally movable relative to the aperture.

27. The stapler of claim 26, wherein the aperture is an arcuate slot.

28. The stapler of claim 26, wherein the aperture is defined in the base member.

* * * * *